United States Patent [19]

Sawai et al.

[11] Patent Number: 4,764,096

[45] Date of Patent: Aug. 16, 1988

[54] SCROLL COMPRESSOR WITH CLEARANCE BETWEEN SCROLL WRAPS

[75] Inventors: Kiyoshi Sawai; Michio Yamamura, both of Kusatsu; Shuuichi Yamamoto, Kyoto; Hiroshi Morokoshi, Shiga, all of Japan

[73] Assignee: Matsushita Electric Industrial Co., Ltd., Osaka, Japan

[21] Appl. No.: 59,223

[22] Filed: May 28, 1987

[30] Foreign Application Priority Data

May 30, 1986 [JP] Japan ..... 61-126058

[51] Int. Cl.[4] ..... F04C 18/04

[52] U.S. Cl. ..... 418/55; 418/57

[58] Field of Search ..... 418/14, 55, 57

[56] References Cited

U.S. PATENT DOCUMENTS 3,924,977 12/1975 McCullough ..... 418/57

4,082,484 4/1978 McCullough ..... 418/57

FOREIGN PATENT DOCUMENTS 55-60684 5/1980 Japan ..... 418/55

59-120794 7/1984 Japan ..... 418/55

*Primary Examiner*—John J. Vrablik

*Attorney, Agent, or Firm*—Spencer & Frank

[57] ABSTRACT

A scroll compressor for use as a refrigerant compressor in an air conditioner or as an air compressor. An orbiting scroll member of the compressor has a drive shaft integral therewith and received in a bore formed in an eccentric bearing which in turn is received in an elongated hole formed in an end surface of a crankshaft such that the eccentric bearing is slidable in the elongated hole. The elongated hole and the eccentric bearing are so sized that the orbiting scroll wrap and a cooperating stationary scroll wrap do not contact with each other. A constant minimum gap is left between both scroll wraps regardless of any change in the centrifugal force acting on the orbiting scroll member due to a change in the operation speed. In consequence, vibration and noise due to contact between both scroll wraps are remarkably reduced and the efficiency of the compressor is improved appreciably.

8 Claims, 2 Drawing Sheets

SCROLL COMPRESSOR WITH CLEARANCE BETWEEN SCROLL WRAPS

BACKGROUND OF THE INVENTION

1. Field of the Invention

The present invention relates to a scroll compressor which is suitable for use as a compressor for an air conditioner or as an air compressor.

2. Discussion of the Prior Art

FIGS. 3*a* and 3*b* show essential portions known scroll compressor which is adapted to be driven at a constant speed. This scroll compressor has a stationary scroll wrap 1*a* and an orbiting scroll wrap 2*a*. The orbiting scroll wrap 2*a* is adapted to make an orbiting motion in sliding contact with the stationary scroll wrap 1*a*, thereby minimizing the radial gap between both wraps so as to minimize internal leakage of the compressed medium from the compression chamber, thereby improving the compression efficiency.

This condition is realized by the following mechanism. FIGS. 3*a* and 3*b* disclose that crankshaft 8 is provided in the upper surface thereof with an elongated bearing-receiving hole 10*a* offset from the axis of the crankshaft. The hole 10*a* receives an eccentric bearing 11 not rotatably but slidably in the longitudinal direction of the hole 10*a* . The elongated hole 10*a* and the eccentric bearing 11 are so sized that the scroll wraps 1*a* and 2*a* contact each other before the eccentric bearing 11 abuts one end wall of the elongated hole 10*a* . The arrangement also is such that an angle which is not greater than 90° is formed between the longitudinal axis of the elongated hole 10*a* and the composite force F composed of the force fg produced by the gas pressure acting on an orbiting scroll member 2 carrying the orbiting scroll wrap 2*a* and the centrifugal force fc acting on the same, at the constant operation speed and under permissible compression load. In normal state of operation, therefore, the composite force F acting on the orbiting scroll member 2 causes the latter to move towards the outer side of the elongated hole 10*a* along the wall of this hole 10*a* . In consequence, the orbiting scroll wrap 2*a* and the stationary scroll wrap 1*a* are always held in contact with each other at a point which moves progressively without any skip.

This known scroll compressor, however, suffers from the following problems. Namely, the stationary scroll wrap and the orbiting scroll wrap have to be precisely finished, otherwise the position of the point of contact between both scroll wraps is changed not continuously, i.e., the position of the contact point moved in a skipping manner, with the result that the amount S of eccentricity is fluctuated so as to cause a collision between the scroll wraps and, hence, high levels of vibration and noise.

Another problem of this scroll compressor is that, since the described construction is designed for operation at a constant speed, it cannot be applied to variable speed type compressors which nowadays are widely used for air conditioning systems. Namely, when the design is made such that a moderate contact pressure between the orbiting scroll member 2*a* and the stationary scroll member 1*a* is obtained at a specific rotation speed, the centrifugal force fc acting on the orbiting scroll member 2 is reduced from the design level when the rotation speed has come down below the specific speed. This undesirably permits the orbiting scroll wrap 2*a* to oscillate on the stationary scroll wrap 1*a* or a large radial gap to be formed between both scroll wraps, so as to allow the gas under compression to leak to the low-pressure side so as to impede the operation of the compressor.

Still another problem is that the contact pressure between both scroll wraps tend to become excessively large, resulting in a rapid wear of the wraps, particularly when the compressor is operating at a high speed.

SUMMARY OF THE INVENTION

Accordingly, an object of the present invention is to provide a scroll compressor in which, under application of an extraordinary load due to, for example, liquid compression or jamming of a foreign object, the radial gap between the wraps is increased so as to protect the compressor. Further, when the scroll compressor is operating normally the gap between both scroll wraps is maintained constant over a wide region of operation speed. This type of operation assures high efficiency, reduced vibration and noise, and reduced wear of wraps.

According to one aspect of the present invention, there is provided a scroll compressor of the type described above, comprising: an elongated hole formed in the end surface of the crankshaft adjacent to the orbiting scroll member and having both longer side surfaces parallel to the axis of the crankshaft; an eccentric bearing having a bore rotatably receiving a drive shaft on the orbiting scroll member and slidable in the longitudinal direction of the elongated hole, the elongated hole and the eccentric bearing being so sized that, when the eccentric bearing is positioned at the outer end of its sliding stroke within the elongated hole, the closest portions of the scroll wraps do not contact with each other; and a resilient member disposed in the space in the elongated hole adjacent to the axis of the crankshaft and adapted to resiliently urge the eccentric bearing into contact with the outer wall surface of the elongated hole.

According to still another aspect, the angle formed between the longitudinal axis of the elongated hole and the direction of a composite force which is composed of the gas compression force and the centrifugal force acting on the orbiting scroll member when the compressor is operating at a predetermined lower minimum operation speed exceeds 90°.

According to a further aspect, the scroll compressor has means for setting the angle formed between the longitudinal axis of the elongated hole and the direction of eccentricity, the means being provided by forming the bearing bore in the eccentric bearing for receiving the drive shaft on the orbiting scroll member at such a position which is offset towards one of the longer side surfaces of the elongated hole.

According to a further aspect, the resilient member for resiliently urging the eccentric bearing into contact with the outer end surface of the elongated hole includes a coiled spring which is seated on a spring seat formed in a surface of the eccentric bearing.

With the arrangement in accordance with the first aspect, the resilient member acts to always press the eccentric bearing resiliently onto the outer wall surface of the elongated hole, regardless of any change in the operation speed. In consequence, a constant eccentricity of the orbiting scroll member is maintained so as to eliminate any variation in the radial gap between both scroll wraps. This enables the compressor to operate at a high efficiency over a wide region of rotational speeds of the compressor. In addition, the levels of vibration and noise are reduced because both scroll wraps do not contact with each other. Furthermore, the amount of eccentricity which is determined by the machining precision of both scroll wraps can easily be set through adjustment of the size of the eccentric bearing.

In another aspect, the arrangement is made such that an angle exceeding 90° is formed between the composite force produced by the gas pressure acting on the orbiting scroll member and the centrifugal force acting on the same and the longitudinal axis of the elongated hole during operation at the minimum rotation speed. With this arrangement, in the event that the compression load is increased abnormally due to suction of liquid refrigerant or oil into the compression chamber, the eccentric bearing can move within the elongated hole in a direction so as to reduce the eccentricity, over the entire region of the operation speed. In consequence, the radial gap between both scroll wraps is increased so as to allow a leak of the compressed fluid from a compression chamber of a higher pressure to a compression chamber of a lower pressure, thus protecting the compressor from an extraordinary load which may otherwise be caused due to compression of liquid phase.

In still another aspect, the elongated hole of the eccentric bearing is offset toward one of the sliding surfaces of the elongated hole, so that the angle of the elongated hole with respect to the direction of eccentricity can set at any desired level without difficulty.

It is to be noted also that the use of a coiled spring as the resilient member together with a spring seat provided on the eccentric bearing prevents the coiled spring and the eccentric bearing from undesirably moving in the axial direction of the crankshaft within the elongated hole during the operation of the compressor.

These and other objects, features and advantages of the present invention will become clear from the following description of the preferred embodiment when the same is read in conjunction with the accompanying drawings.

DESCRIPTION OF THE PREFERRED EMBODIMENT

A preferred embodiment of the scroll compressor in accordance with the present invention will be described hereinunder with reference to the accompanying drawings.

Figure 1:
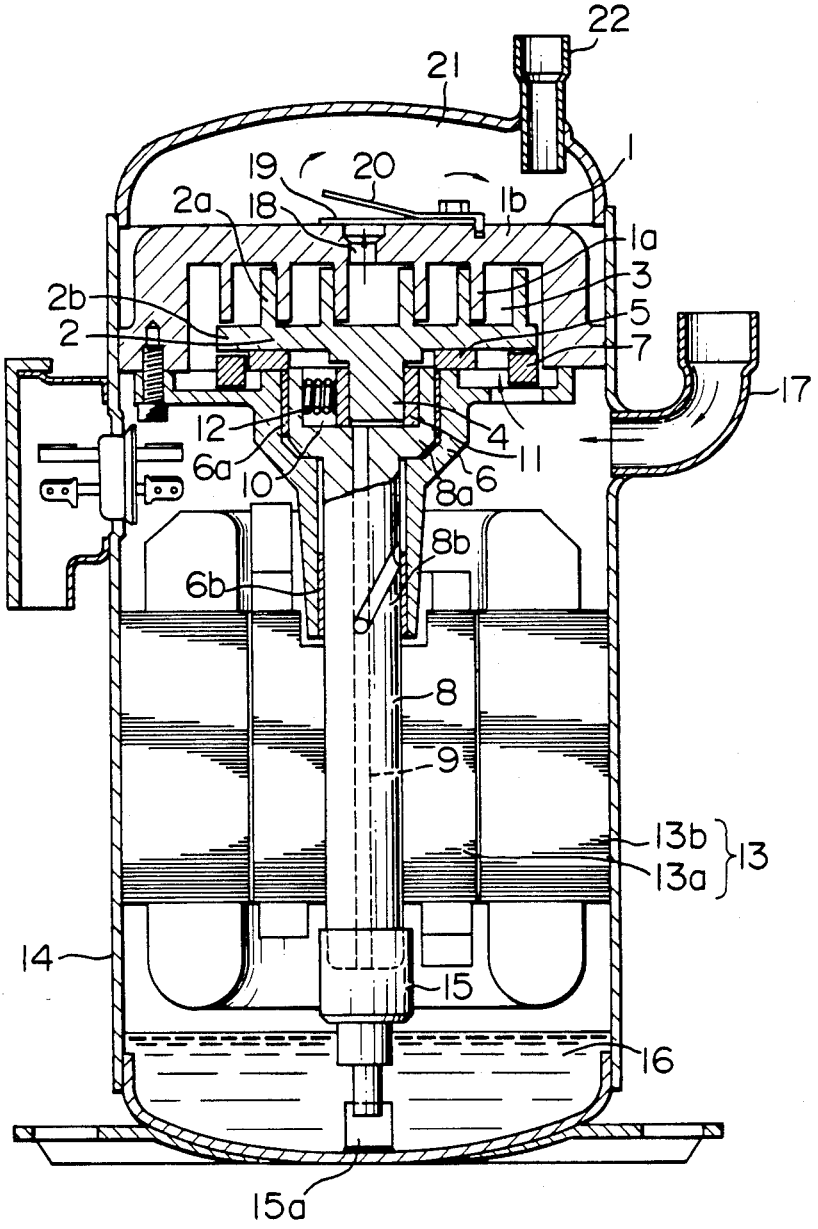
FIG. 1 is a vertical sectional view of a scroll compressor in accordance with the present invention.
Figure 2:
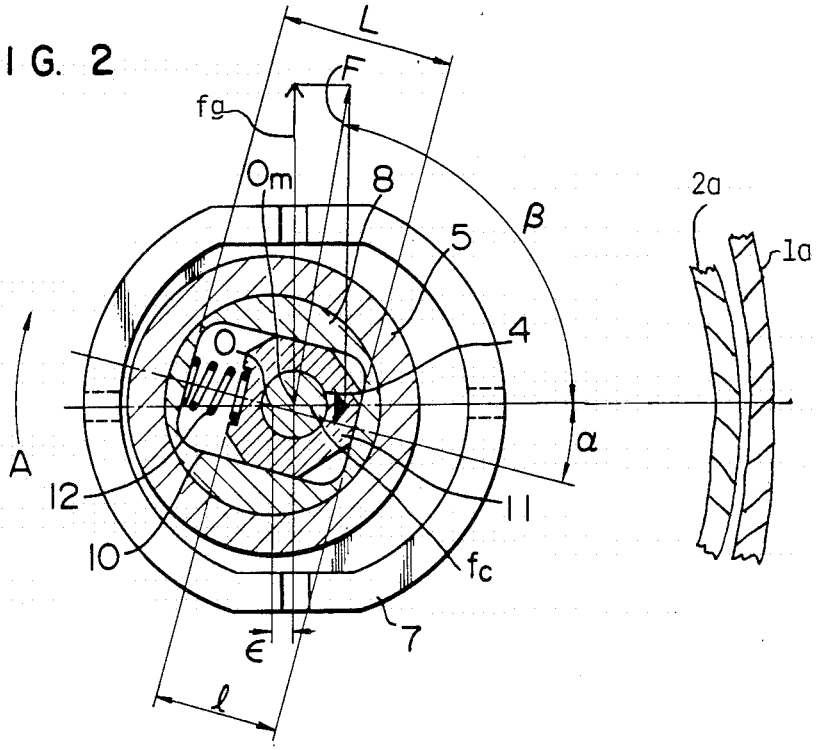
FIG. 2 is a cross-sectional view of an essential portion of the scroll compressor in accordance with the present invention.
Figure 3A:
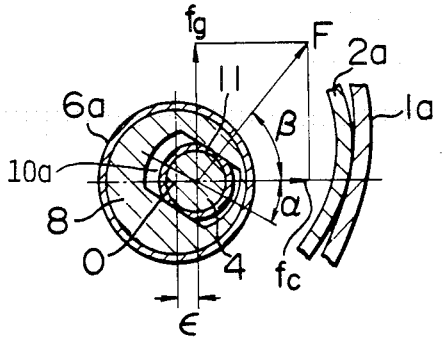
FIG. 3a PRIOR ART
FIGS. 3*a* and 3*b* are cross-sectional views of an essential portion of a conventional scroll compressor.
Figure 3B:
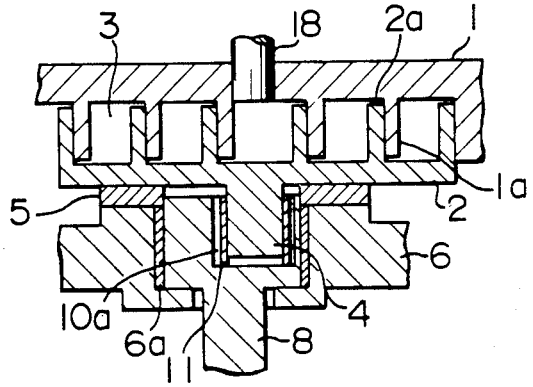
FIG. 3b PRIOR ART

FIGS. 1 and 2 show a scroll compressor embodying the present invention, suitable for use as, for example, a refrigerator compressor in an air conditioner.

Referring to these figures, the compressor has a stationary scroll member 1 composed of an end plate 1*b* and a scroll wrap 1*a* formed on the end plate, and an orbiting scroll member 2 composed of an end plate 2*b* and a scroll wrap 2*a* formed on the end plate 2*b*. Both the scroll wraps 1*a* and 2*a* are formed along involute or similar curves and are arranged to mesh with each other so as to form compression chambers 3 therebetween. The orbiting scroll member 2 is provided with a drive shaft or boss 4 which projects from the center of the rear surface of the end plate 2*b* thereof. The compressor further has a thrust bearing 5 which supports the wall 2*b* of the orbiting scroll wrap 2*a* , a bearing member 6 which is secured to the stationary scroll member 1 by means of, for example, bolts, a member 7 adapted for engagement both with the orbiting scroll member 2 and the bearing part 6 so as to prevent the orbiting scroll member 2 from rotating about its own axis, and a crankshaft 8 for driving the orbiting scroll member 2 and having an oil passage bore 9 formed along the axis thereof. The crankshaft 8 has a first shaft portion 8*a* and a second shaft portion 8*b*. The first shaft portion 8*a* and the second shaft portion 8*b* of the crankshaft 8 are rotatably supported, respectively, by a first bearing 6*a* and a second bearing 6*b* which are disposed on the upper side and the lower side of the bearing member 6.

An elongated hole 10 is formed in the end surface of the first shaft portion 8*a* of the crankshaft 8 adjacent to the orbiting scroll member 2. The elongated hole 10 has side walls which are parallel to the axis of the crankshaft 8 and a neutral axis which passes the axis of the crankshaft 8. A reference numeral 11 designates an eccentric bearing 11 which rotatably receives the drive shaft 4 on the orbiting scroll member 2. The eccentric bearing in turn is received in the elongated hole 10 so as not to be not rotatable but rather slidable in the longitudinal direction of the elongated hole 10. A coiled spring 12 is loaded in the elongated hole 10 so as to produce a force directed towards the axis of the eccentric shaft 8, thereby urging the eccentric bearing 11 onto the outer end surface of the elongated hole 10. The length L of the elongated hole 10 and the size l of the eccentric bearing 11 are determined so that an extremely small minimum gap is formed between the stationary scroll wrap 1*a* and the orbiting scroll wrap 2*a* in the region where both scroll wraps are closest to each other.

The crankshaft 8 is adapted to be driven by an electric motor 13 which is composed of a rotor 13*a* integral with the crankshaft 8 and a stator 13*b*.

The scroll compressor is thus composed generally of a compressor section constituted by the orbiting and stationary scroll members 1,2 and a motor section constituted by the motor 13, both the compressor section and the motor section are accommodated by a hermetic container which is denoted by a numeral 14. A reference numeral 15 designates an oil pump which is connected to one end of the crankshaft 8 and adapted for rotating as a unit with the crankshaft 8. The oil pump 15 has a shaft which is fixed against rotation by being connected to a retainer plate 15*a* which in turn is fixed to a lower portion of the hermetic container 14 by, for example, welding. The hermetic container defines an oil well at its lower end portion in which is pooled a refrigerator oil denoted by a numeral 16. A refrigerant gas is sucked into the hermetic container through a suction pipe 17 connected to the latter. The refrigerant gas is then compressed in the compressor section and is discharged through a discharge system which includes a discharge port 18 formed in a central region of the end plate 1*b* of the stationary scroll member, a discharge valve 19 which is situated to cover the discharge port 18, a valve retainer 20, which retains the valve 19, a discharge chamber 21 and a discharge pipe 22 leading to the outside of the hermetic container.

Referring to FIG. 2, the distance or amount of offset or eccentricity of the axis Om of the drive shaft 4 of the orbiting scroll wrap from the axis o of the crankshaft 8 is designated by a symbol $\frac{1}{3}$. The direction of rotation of the crankshaft 8 is indicated by an arrow A. A force F is composed of the centrifugal force fc acting on the orbiting scroll member 2 and the force fg produced by the gas pressure acting on the orbiting scroll member 2. The angle formed between the longitudinal axis of the elongated hole 10 and the direction of eccentricity of the orbiting scroll member 2 is indicated by an angle $\alpha$, while the angle formed between the above-mentioned direction of offset and the composite force F is indicated by $\beta$.

In operation, as the stator 13*b* of the electric motor 13 is energized, a torque is generated to rotate the rotor 13*a* together with the crankshaft 8. As the crankshaft 8 rotates, torque is transmitted to the drive shaft 4 of the orbiting scroll member 2 through the elongated hole 10 in the crankshaft 8 and the eccentric bearing 11. As a consequence, the orbiting scroll member 2 makes an orbiting motion on the thrust bearing 5 about the axis 0 of the crankshaft 8, due to the presence of the member 7 which prevents the orbiting scroll member 2 from rotating about its own axis. In consequence, compression chambers formed between both scroll wraps progressively decrease their volumes, thereby compressing the refrigerant gas.

As a consequence, the gas is sucked through the suction pipe 17 into the space in the hermetic container 14 and is induced into one of the compression chambers 3 through an opening forced in the bearing member 6, as indicated by an arrow. The gas is then compressed in the compression chamber 3 to high pressure and temperature. The gas is then discharged into the discharge chamber 21 and is then delivered to the outside of the container 14 through the discharge pipe 22.

The compressor normally operates in the manner explained above. According to the invention, the angle $\alpha+\beta$ formed between the longitudinal axis of the elongated hole 10 and the composite force F formed by the gas pressure fg and the centrifugal force fc is not less than 90°. The composite force, therefore, tends to displace the eccentric bearing 11 in such a direction as to reduce the amount of eccentricity of the orbiting scroll member 2. On the other hand, the spring constant of the coiled spring 12 is determined so that the coiled spring 12 produces an urging force which is at least large enough to urge the eccentric bearing 11 to a desired position, i.e., to keep the eccentric bearing in contact with the outer end wall of the elongated hole 10, overcoming the above-mentioned composite force F. As a consequence, the eccentricity $\epsilon$ is maintained constant over a wide range of operational speeds of the compressor, so that both scroll wraps operate without contacting each other, i.e., maintaining the constant minimum gap left therebetween.

It will be understood that the compressor can operate with reduced levels of vibration and noise, and the compression efficiency is increased while the wear of the scroll wraps is minimized.

With this arrangement, it is possible to obtain a large angle $\alpha$ formed between the longitudinal axis of the elongated hole and the direction of eccentricity. In the event that the refrigerant is sucked in liquid state or the lubricating oil is sucked, the compression load exceeds the allowable level when the operation speed is low or high. According to the invention, the angle $\alpha+\beta$ formed between the longitudinal axis of the elongated hole 10 and the composite force F largely exceeds 90° so that a force component F′ of the composite force F, represented by $F'=F\cos(\alpha+\beta)$ acts to displace the eccentric bearing 11 in the longitudinal direction of the elongated hole so as to reduce the amount $\epsilon$, overcoming the urging force exerted by the coiled spring 12. As a consequence, the radial gap between the scroll wraps is increased so as to increase the rate of leak of the gas from a compression chamber 3 of a higher pressure into another compression chamber 3 of a lower pressure, thus reducing the compression load and thereby protecting the compressor from an abnormal force which may otherwise be caused by a phenomenon known as "liquid compression".

The same effect is produced also when foreign matter has been introduced into the compression chamber 3. Namely, in this case, the eccentric bearing 11 and, hence, the orbiting scroll member is displaced to reduce the amount e of eccentricity so that the radial gap between both scroll wraps is increased to allow the compressor to operate without stopping until the foreign matter is removed and discharged from the discharge port 18.

It is also noted that, since the bearing bore in the eccentric bearing 11, is formed at an offset towards one of the slide surfaces of the bearing 11 as shown in FIG. 2 so as, to form a definite angle between the direction of eccentricity and the longitudinal axis of the elongated hole 10, the elongated hole 10 may be positioned so as to pass the axis 0 of the crankshaft 8. This facilitates the machining of the elongated hole 10 appreciably.

In addition, the resilient member for urging the eccentric bearing 11 onto the outer end wall of the elongated hole 10 is constituted by the coiled spring 12 seated on a spring seat recessed in the surface of the eccentric bearing 11, any tendency for the coiled spring 12 and the eccentric bearing 11 to move within the elongated hole 10 in the axial direction of the crankshaft 8 is suppressed so as to ensure that the eccentric bearing 11 always functions safely within the elongated hole 10.

As will be understood from the foregoing description, according to the invention, the eccentric bearing which receives the drive shaft of the orbiting scroll member is received in the elongated hole which is formed in the end surface of the crankshaft such that the eccentric bearing can slide within the elongated hole in a direction so as to reduce the amount of eccentricity. The eccentric bearing is normally urged by the coiled spring into contact with one end wall of the elongated hole so as to ensure a minimum gap is formed between both scroll wraps in the radial direction, i.e., to prevent both scroll wraps from contacting each other. This arrangement enables the amount of eccentricity to be set easily while ensuring that a constant minimum radial gap is maintained between both scroll wraps, thus reducing the levels of vibration and noise, while affording a higher efficiency of the compressor.

In addition, the arrangement is such that the angle formed between the longitudinal axis of the elongated hole and the composite force of the compression force and the centrifugal force exceeds 90° when the compressor is operating at the minimum operation speed. This ensures that the compressor is protected against any extraordinary load such as that caused when the refrigerant is compressed in liquid state over the entire range of operational speeds, thus assuring a high reliability of the compressor.

It is also to be understood that bearing bore for receiving the drive shaft on the orbiting scroll member is formed at an offset towards one of the sliding surfaces of the eccentric bearing, so that the elongated hole for receiving the eccentric bearing can be machined easily.

The use of the coiled spring as the resilient member in cooperation with a recessed spring seat formed in the surface of the eccentric bearing suppresses any tendency for the spring and the eccentric bearing to be moved in the axial direction of the crankshaft, thereby allowing the eccentric bearing to operate safely within the elongated hole, thus offering a high reliability of operation of the compressor.

Although the invention has been described through specific terms, it is to be noted that the described embodiment is only illustrative and various changes and modifications may be imparted thereto without departing from the scope of the invention which is limited solely by the appended claims.

What is claimed is:

1. A scroll compressor having an orbiting scroll member and a stationary scroll member each having an end plate and a psiral scroll wrap formed on one side of said end plate, said orbiting and stationary scroll members being assembled together such that said wraps mesh with each other, a crankshaft for eccentrically driving said orbiting scroll member, a bearing member for supporting said crankshaft member, and a member for preventing said orbiting scroll member from rotating about its own axis, said scroll compressor comprising:

an elongated hole formed in the end surface of said crankshaft adjacent to said orbiting scroll member and having an outer end surface and two longer side surfaces, wherein both said longer side surfaces are parallel to the axis of said crankshaft;

an eccentric bearing having a bore rotatably receiving a drive shaft of said orbiting scroll member and slidable in the longitudinal direction of said elongated hole, said elongated hole and said eccentric bearing being so sized that, when said eccentric bearing is positioned at the outer end of its sliding stroke within said elongated hole, the closest portions of said scroll wraps do not contact with each other; and a resilient member disposed in the space of said elongated hole adjacent to the axis of said crankshaft and adapted to resiliently urge said eccentric bearing into contact with said outer end surface of said elongated hole.

2. A scroll compressor according to claim 1 wherein said resillient member for resiliently urging said eccentric bearing into contact with said outer end surface of said elongated hole includes a coiled spring which is seated on a spring seat formed in a surface of said eccentric bearing.

3. A scroll compressor according to claim 1, wherein the sum of a first angle formed between the longitudinal axis of said elongated hole and the direction of eccentricity of said orbiting scroll member and a second angle formed between said direction of eccentricity and the direction of a composite force which is composed of the gas compression force and the centrifugal force acting on said orbiting scroll member when said compressor is operating at a predetermined lower minimum operation speed exceeds 90°.

4. A scroll compressor according to claim 3, wherein said resilient member for resiliently urging said eccentric bearing into contact with said outer send surface of said elongated hole includes a coiled spring which is seated on a spring seat formed in a surface of said eccentric bearing.

5. A scroll compressor according to claim 3 comprising means for setting the angle formed between said longitudinal axis of said elongated hole and said direction of eccentricity, said means being provided by forming the bearing bore in said eccentric bearing for receiving said drive shaft of said orbiting scroll member at such a position which is offset towards one of the slidable longer side surfaces of said eccentric bearing.

6. A scroll compressor according to claim 5, wherein said resilient member for resiliently urging said eccentric bearing into contact with said outer end surface of said elongated hole includes a coiled spring which is seated on a spring seat formed in a surface of said eccentric bearing.

7. A scroll compressor having an orbiting scroll member and a stationary scroll member each having an end plate and a spiral scroll wrap formed on one side of said end plate, said orbiting and stationary scroll members being assembled together such that said wraps mesh with each other, a crankshaft for eccentrically driving said orbiting scroll member, a bearing member for supporting said crankshaft, and a member for preventing said orbiting scroll member from rotating about its own axis, said scroll compressor comprising:

an elongated hole formed in the end surface of said crankshaft adjacent to said orbiting scroll member and having an outer end surface and two longer side surfaces, wherein both said longer side surfaces are parallel to the axis of said crankshaft;

an eccentric bearing having a bore rottably receiving a drive shaft of said orbiting scroll member and slidable in the longitudinal direction of said elongated hole, said elongated hole and said eccentric bearing being so sized that, when said eccentric bearing is positioned at the outer end of its sliding stroke within said elongated hole, the closed portions of said scroll wraps do not contact with each other; and a resilient member disposed in the space of said elongated hole adjacent to the axis of said crankshaft and adapted to resiliently urge said eccentric bearing into contact with said outer end surface of said elongated hole;

wherein the sum of a first angle formed between the longitudinal axis of said elongated hole and the direction of eccentricity of said orbiting scroll member and a second angle formed between said direction of eccentricity and the direction of a composite force which is composed of the gas compression force and the centrifugal force acting on said orbiting scroll member when said compressor is operating at a predetermined lower miinimum operation speed exceeds 90°.

8. A scroll compressor having an orbiting scroll member and a stationary scroll member each having an end plate and a spiral scroll wrap formed on one side of said end plate, said orbiting and stationary scroll members being assembled together such that said wraps mesh with each other, a crankshaft for eccentrically driving said orbiting scroll member, a bearing member for supporting said crankshaft, and a member for preventing said orbiting scroll member from rotating about its own axis, said scroll compressor comprising:

an elongated hole formed in the end surface of said crankshaft adjacent to said orbiting scroll member and having an outer end surface and two longer side surfaces, wherein both said longer side surfaces are parallel to the axis of said crankshaft;

an eccentric bearing having a bore rottably receiving a drive shaft of said orbiting scroll member and slidable in the longitudinal direction of said elongated hole, said elongated hole and said eccentric bearing being so sized that, when said eccentric bearing is positioned at the outer end of its sliding stroke within said elongated hole, the closest portions of said scroll wraps do not contact with each other;

a resilient member disposed in the space of said elongated hole adjacent to the axis of said crankshaft and adapted to resiliently urge said eccentric bearing into contact with said outer end surface of said elongated hole; and means for setting the angle formed between said longitudinal axis of said elongated hole and said direction of eccentricity, said means being provided by forming the bearing bore in said eccentric bearing for receiving said drive shaft of said orbiting scroll member at such a position which is offset towards one of the slidable side surface of said eccentric bearing.

* * * * *